US009985379B2

(12) United States Patent
Ting et al.

(10) Patent No.: US 9,985,379 B2
(45) **Date of Patent: *May 29, 2018**

(54) ELECTRICAL CONNECTOR AND THE METHOD OF MAKING THE SAME

(71) Applicant: FOXCONN INTERCONNECT TECHNOLOGY LIMITED, Grand Cayman (KY)

(72) Inventors: Chien-Jen Ting, New Taipei (TW); Zhi-Feng Wang, Kunshan (CN); Da-Chun Li, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/289,987

(22) Filed: Oct. 11, 2016

(65) Prior Publication Data

US 2017/0104290 A1 Apr. 13, 2017

(30) Foreign Application Priority Data

Oct. 12, 2015 (CN) ..... 2015 1 0653450

(51) Int. Cl.

| | |
|---|---|
| ***H01R 13/504*** | (2006.01) |
| ***H01R 43/20*** | (2006.01) |
| ***H01R 12/71*** | (2011.01) |
| ***H01R 13/405*** | (2006.01) |
| ***H01R 13/52*** | (2006.01) |

(52) U.S. Cl.
CPC ..... *H01R 13/504* (2013.01); *H01R 13/405* (2013.01); *H01R 13/5213* (2013.01); *H01R 43/20* (2013.01); *H01R 12/716* (2013.01)

(58) Field of Classification Search
CPC H01R 13/504; H01R 12/716; H01R 13/5216; H01R 13/405; H01R 43/20
USPC ..... 439/701, 724, 599, 634
See application file for complete search history.

(56) References Cited

U.S. PATENT DOCUMENTS 9,425,542 B1 * 8/2016 Wu ..... H01R 13/521

FOREIGN PATENT DOCUMENTS

TW M449374 10/2012

* cited by examiner

*Primary Examiner* — Renee Iuebke
*Assistant Examiner* — Paul Baillargeon
(74) *Attorney, Agent, or Firm* — Wei Te Chung; Ming Chieh Chang

(57) ABSTRACT

An electrical connector (100) comprises an insulative housing (1), a cover (50) and a plurality of terminals (32) retained in the insulative housing (1). The insulative housing (1) includes a base (10), the base (10) defines a first region (13) disposed on the lower surface thereof. The electrical connector (100) further comprises a body portion (40) injection molded on the first region (13). The body portion (40) is disposed between the insulative housing (1) and the cover (50) and defining at least one spot-welded portion (43). The cover (50) is spot-welded on the spot-welded portion (43) of body portion (40) so as to cover the insulative housing (1).

20 Claims, 8 Drawing Sheets

ELECTRICAL CONNECTOR AND THE METHOD OF MAKING THE SAME

BACKGROUND OF THE INVENTION

1. Field of the Invention

The present invention relates to an electrical connector and the method of making the same, and more particularly to an electrical connector and the method of making the same having a structure easily spot-welded. The application relates to the copending application filed on the same day with the same applicant, having a title of "ELECTRICAL CONNECTOR HAVING IMPROVED WATER-PROOF FUNCTION".

2. Description of Related Art

Due to the limitations of the current technology of the plastic spot-welding, some materials of the specified structure couldn't complete the process of spot-welding, so as to make the success rate of spot-welding of products very low.

An electrical connector with an improved indication effect is desired.

BRIEF SUMMARY OF THE INVENTION

Accordingly, an object of the present invention is to provide an electrical connector having improved spot-welding effect.

In order to achieve the above-mentioned object, an electrical connector comprises an insulative housing, a cover and a plurality of terminals retained in the insulative housing. The insulative housing includes a base; the base defines a first region disposed on the lower surface thereof. The electrical connector further comprises a body portion injection molded on the first region. The body portion is disposed between the insulative housing and the cover and defining at least one spot-welded portion. The cover is spot-welded on the spot-welded portion of body portion so as to cover the insulative housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
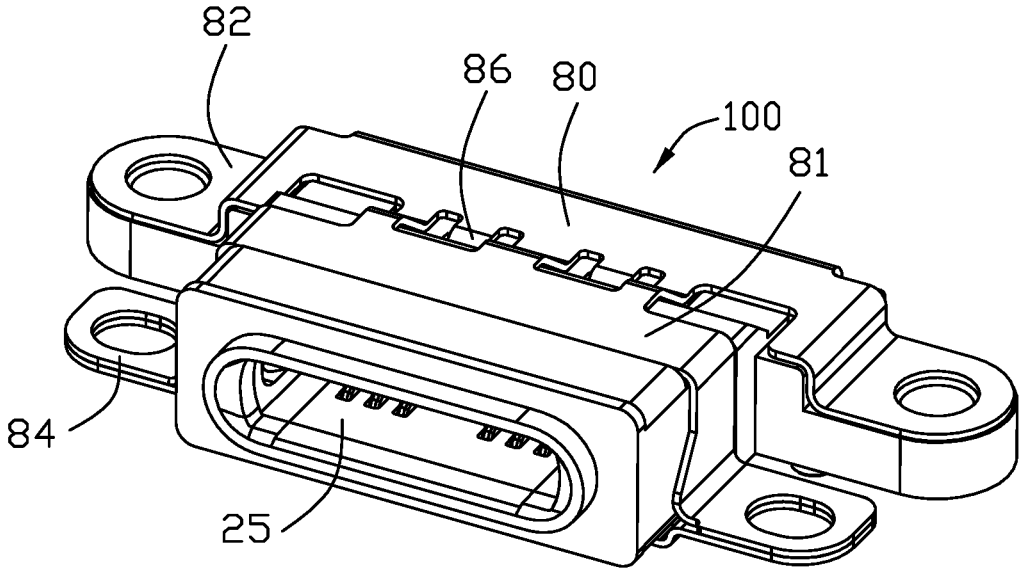
FIG. 1 is a perspective view of an electrical connector according to the present invention.
Figure 2:
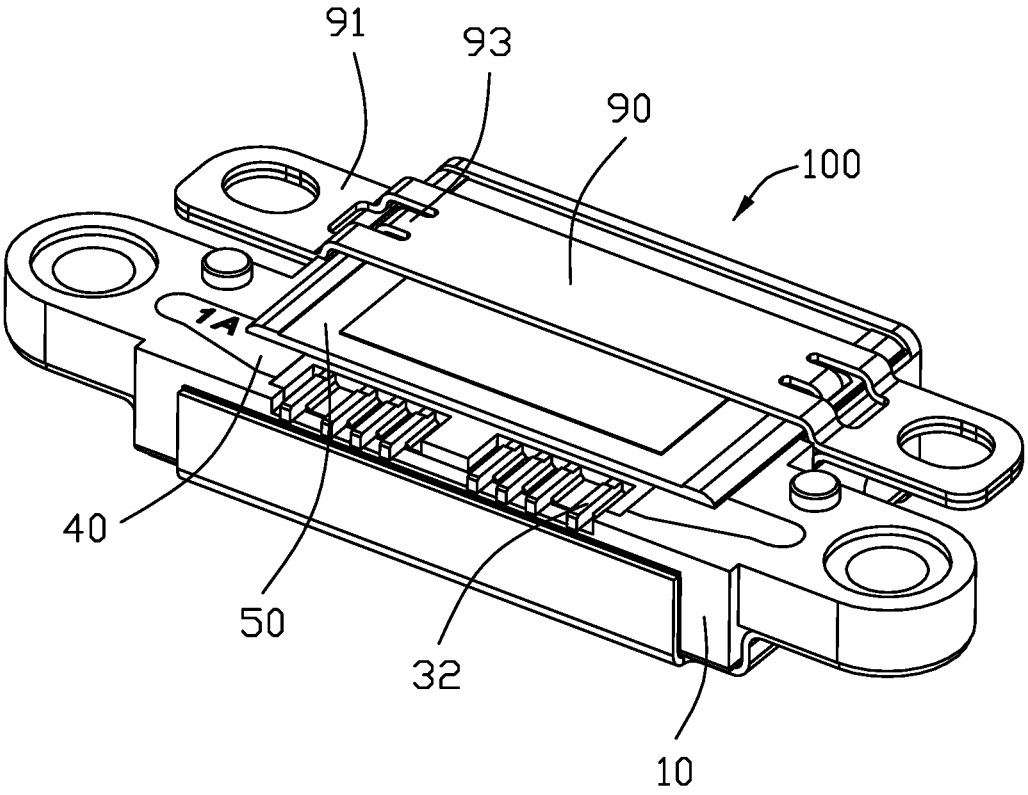
FIG. 2 is another perspective view of the electrical connector shown in FIG. 1.
Figure 3:
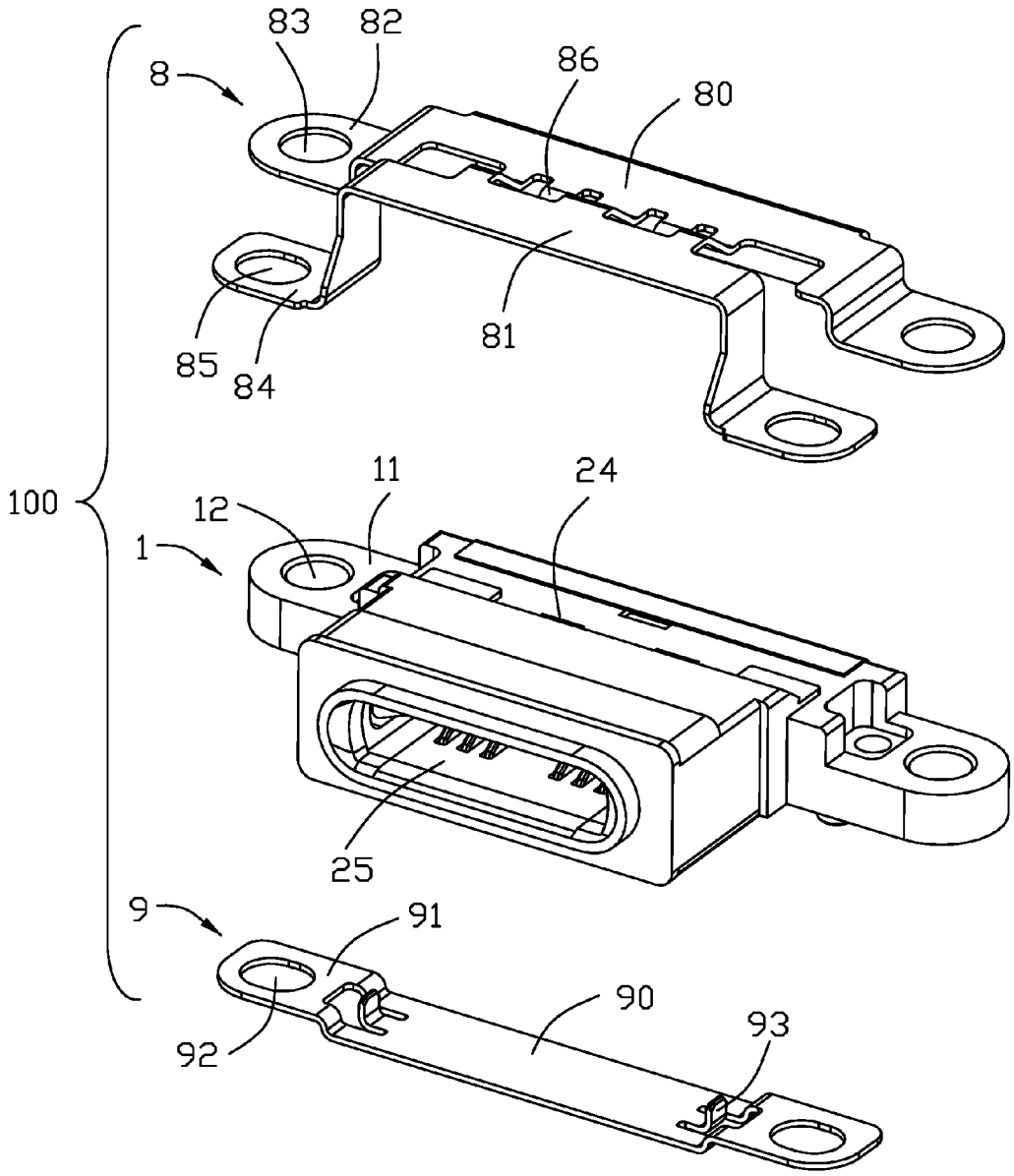
FIG. 3 is a perspective, partly exploded view of the electrical connector shown in FIG. 1.
Figure 4:
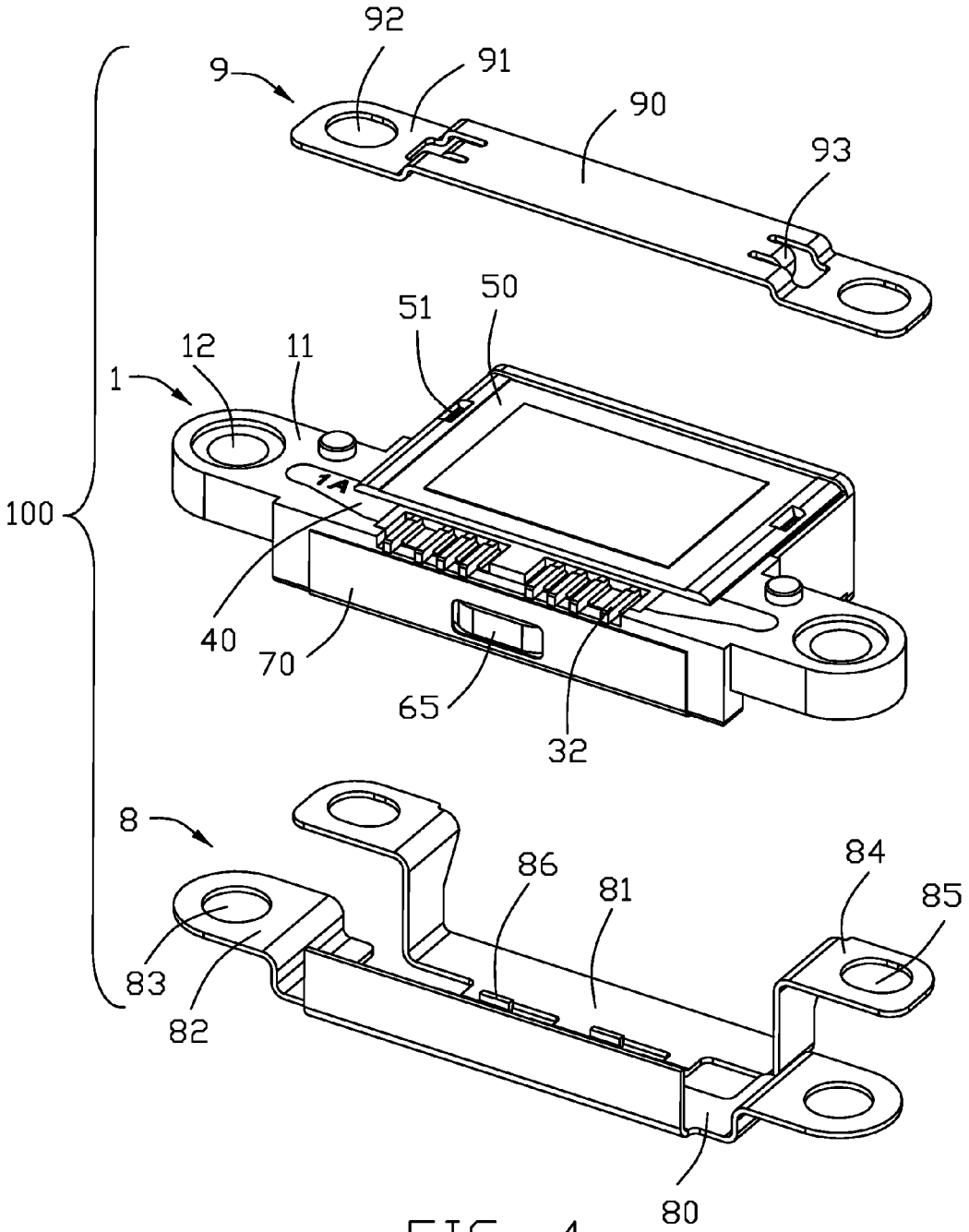
FIG. 4 is another perspective, partly exploded view of electrical connector shown in FIG. 3.
Figure 5:
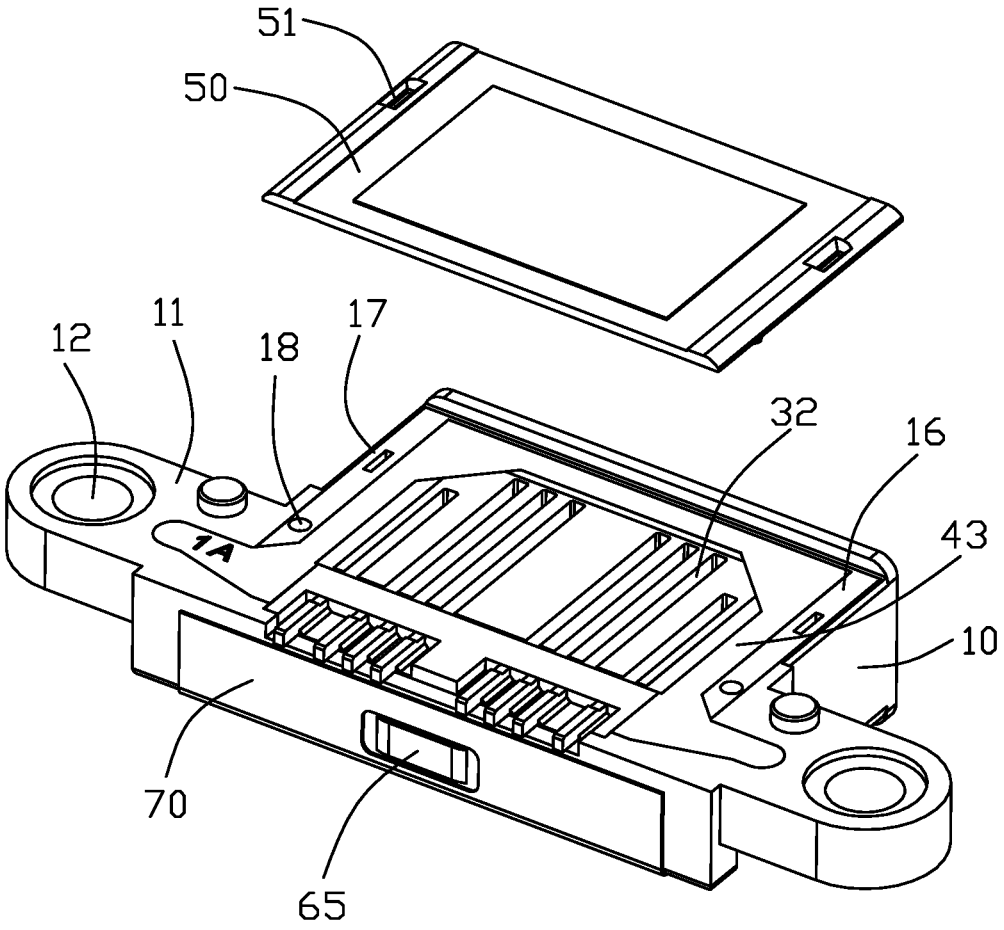
FIG. 5 is a perspective, partly exploded view of a part of the electrical connector shown in FIG. 4.
Figure 6:
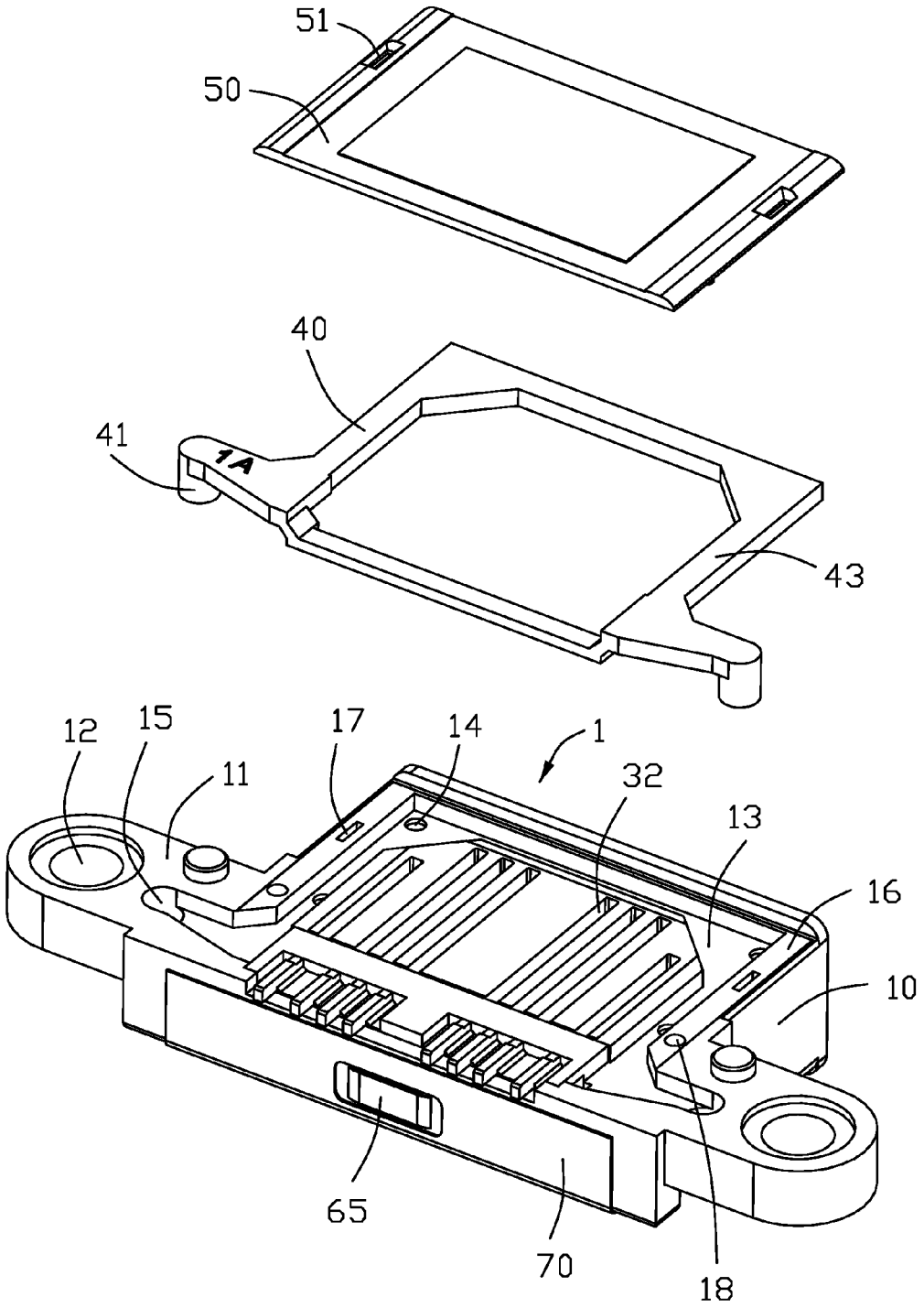
FIG. 6 is a further perspective, partly exploded view of the part of the electrical connector shown in FIG. 5.
Figure 7:
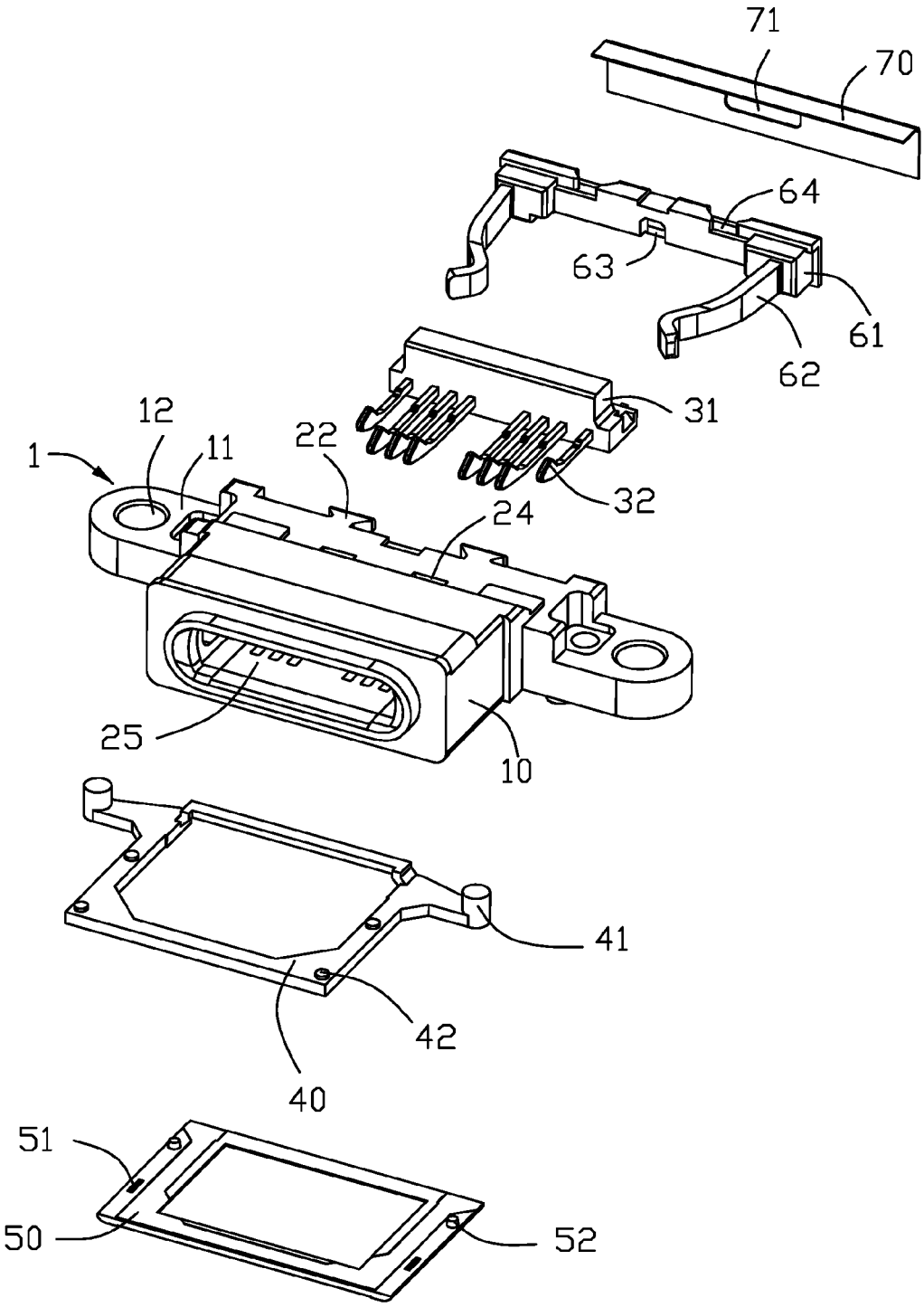
FIG. 7 is a perspective, exploded view of the part of the electrical connector shown in FIG. 1.
Figure 8:
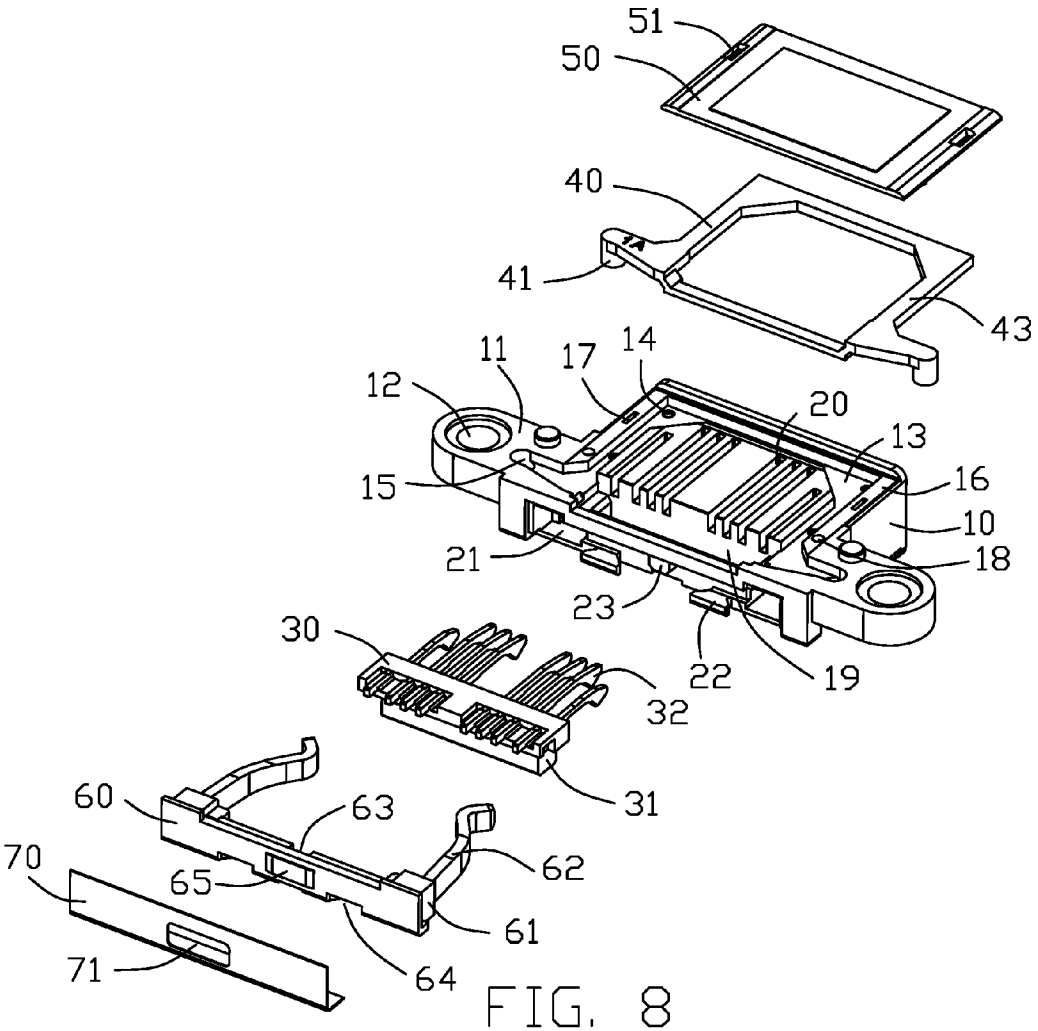
FIG. 8 is another perspective, exploded view of the part of electrical connector shown in FIG. 7.

Referring to FIGS. 1-8, an electrical connector 100 is in accordance with the present invention. Any direction related to the present invention is referenced to FIG. 1. The electrical connector 100 includes an insulative housing 1, a first reinforcing member 8 and a second reinforcing member 9 surrounding the insulative housing 1.

Referring to FIG. 3-8, the insulative housing 1 includes a base 10 and two first stretching portions 11 extending along two sides of the base 10, the first stretching portion 11 defines a first aligning hole 12. The base 10 defines a first reign 13 recessed from the lower surface thereof, a second reign 16 disposed on the lower surface thereof, a pair of first positioning grooves 24 disposed on the upper surface thereof, a receiving space 25 recessed from the front thereof, a first groove 19 and a plurality of terminal grooves 20 disposed on the lower surface thereof. The first reign 13 defines a pair of first retainers 14 and a pair of concave feet 15 outwardly extending from two sides of the rear thereof. The second reign 16 includes a pair of first aligning slits 17 and a pair of second retainers 18 disposed on both sides thereof. The base 10 includes a pair of second grooves 21, a pair of first tabs 22 and a second tab 23 located on the rear thereof.

The electrical connector 100 defines a first housing 30, a third tab 31 extending upwardly from the first housing 30 and a plurality of terminals 32 retained in the first housing 30. The third tab 31 is assembled to the first groove 19 of the base 10, and the terminals 32 are inserted to the terminal grooves 20 of the base 10.

The electrical connector 100 includes a filling frame 60 assembled on the rear side of the base 10, the filling frame 60 defines a pair of fourth tabs 61, a third groove 63 disposed between said two fourth tabs 61, a pair of fourth grooves 64 and a fifth tab 65. Each fourth tab 61 defines a locking member 62 extending forwardly therefrom. The fourth tabs 61 match with the second grooves 21 of the base 10, the locking members 62 are exposed in the receiving space 25 of the base 10 for electrically connecting with the mating connector. The second tab 23 of the base 10 is disposed in the third groove 63, and the first tabs 22 of the base 10 passes through the fourth groove 64.

The electrical connector 100 further includes a rear cover 70 covering the rear surface of the filling frame 60 and retained to the rear surface of the base 10. The rear cover 70 defines a receiving groove 71 to receive the fifth tab 65 of the filling frame 60.

The electrical connector 100 includes a body portion 40, the body portion 40 defines a pair of convex feet 41 disposed on both sides thereof, a plurality of spot-welded portions 43 and a pair of first convex portions 42. The body portion 40 is injection molded on the first region 13 of the base 10, the convex feet 41 are injection molded in the concave feet 15 and the first convex portions 42 are injection molded in the first retainers 14 of the base 10.

The electrical connector 100 includes a cover 50 assembled to the body portion 40, the cover 50 defining a pair of second aligning slits 51 and a pair of second convex portions 52 disposed on both sides thereof. The cover 50 shields the body portion 40 and locks to the base 10, the second aligning slits 51 are aligned with the first aligning slits 17 of the base 10 to form a mating reign, the second convex portions 52 are retained in the second retainers 18 of the base 10.

The first reinforcing member 8 defines a first main body 80 and second main body 81 connected to each other by a pair of first retaining clip 86, the first retaining clips 86 are matched with the first positioning grooves 24 of the base 10. The main body 80 includes a pair of second stretching members 82 disposed at two sides thereof and a pair of second aligning holes 83 respectively disposed on the second stretching members 82, the second aligning holes 83 are aligned with the first aligning hole 12 of the base 10. The second body portion 81 includes a pair of third stretching portions 84 respectively disposed at two sides thereof, each third stretching portion 84 defines a third aligning hole 85.

The second reinforcing member 9 includes a third main body 90, a pair of fourth stretching member 91 and a pair of second retaining clips 93 disposed on two sides of the third main body 90. Each fourth stretching member 91 defines a fourth aligning hole 92 mated with the third aligning hole 85 of the first reinforcing member 8. The second retaining clips 93 are mated with the mating reign formed from the second aligning slits 51 of the cover and first aligning grooves 17 of the base 10.

When the first housing 30 of the electrical connector 100 is assembled to the first groove 19 of the base 10 along a down-to-up direction, the terminals 30 of the first housing 30 are retained in the terminal groove 20 of the base 10.

When the filling frame 60 of the electrical connector 100 is inserted into the receiving space 25 of the base 10, the fourth tabs 61 are filled into the second grooves 21 of the base 10, the locking members 62 are exposed to the receiving space 25 of the base 10 for electrically connecting with the mating connector, the second tab 23 of the base 10 is disposed in the third groove 63, and the first tabs 22 of the base 10 passes through the fourth groove 64.

The rear cover 70 of the electrical connector 100 is covering the rear surface of the filling frame 60 and retained to the rear surface of the base 10, the receiving groove 71 of the rear cover 70 is receiving the fifth tab 65 of the filling frame 60.

The body portion 40 is injection molded on the first region 13, the convex feet 41 are injection molded in the concave feet 15, and the first convex portions 42 of the body portion 40 are injection molded in the first retainers 14 of the base 10.

The cover 50 of the electrical connector 100 covers the surface of the body portion 40 in a down-to-up direction, the second aligning slits 51 of the cover 50 are aligned to the first aligning slits 17 of the base 10 to form a mating reign, the second convex portions 52 of the cover 50 are inserted into the second retainers 18 of the base 10.

The body portion 40 and the cover 50 are made of the material easily spot-welded, the cover 50 is spot-welded on the spot-welded portion 43 of body portion 40 so as to cover the lower surface of the insulative housing 1.

The first reinforcing member 8 and second reinforcing member 9 shield the insulative housing 1. The first reinforcing member 8 is assembled to the insulative housing 1 along a up-to-down direction, so the first retaining clips 86 of the first reinforcing member 8 are retained in the first positioning grooves 24 of the insulative housing 1, the second aligning holes 83 of the first reinforcing member 8 are respectively aligned with the first aligning holes 12 of the insulative housing 1. The second reinforcing member 9 is assembled to the insulative housing 1 along a down-to-up direction, the second retaining clips 93 of the second reinforcing member 9 are mated with the mating reign, the fourth aligning holes 92 of the second reinforcing member 9 are respectively aligned with the third aligning holes 85 of the first reinforcing member 8.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector comprising:

an insulative housing including a base, the base defining a first region disposed on a lower surface thereof;

a cover covering on the insulative housing; and a plurality of terminals retained in the insulative housing; wherein the electrical connector further comprises a body portion injection molded on the first region, the body portion is disposed between the insulative housing and the cover and defining at least one spot-welded portion, the cover is spot-welded on the spot-welded portion of the body portion so as to cover the insulative housing.

2. The electrical connector as claimed in claim 1, wherein the base defines a second region including a pair of first aligning slits, the cover includes a pair of second aligning slits aligned with the first aligning slits.

3. The electrical connector as claimed in claim 1, wherein the base is inwardly recessed from the lower surface to form the first region.

4. The electrical connector as claimed in claim 1, wherein the first region is a frame shape, and the body portion and the cover are also a frame shape, the cover shields on the surface of the body portion in a down-to-up direction.

5. The electrical connector as claimed in claim 1, wherein the first region extends outwardly to form two concave feet disposed at two sides thereof, the body portion extends outwardly to form two convex feet disposed at two sides thereof and matching with the concave feet.

6. The electrical connector claimed in claim 1, wherein the body portion and the cover are made of material spot-welded.

7. The electrical connector claimed in claim 1, further including a filling frame, wherein the insulative housing defines a pair of second grooves and a receiving space, the filling frame is filled in the second grooves and enclosed in the receiving space.

8. The electrical connector claimed in claim 7, further including a rear cover, the rear cover is surrounding the rear surface of the filling frame and retained to a rear surface of the insulative housing.

9. A method of making of an electrical connector comprising the steps of:

providing an insulative housing having a base, the base defining a first region disposed on the lower surface thereof;

providing a body portion injection molded on the first region, and the body portion defining at least one spot-welded portion; and providing a cover spot-welded on the spot-welded portion of the body portion so as to cover the insulative housing.

10. The method claimed in claim 9, wherein the base forms a first region recessed from the lower surface thereof during a procedure of providing insulative housing.

11. The method claimed in claim 9, further comprising providing a filling frame, the insulative housing defines a pair of second grooves and a receiving space, the filling frame is filled in the second grooves and enclosed in the receiving space.

12. The method claimed in claim 9, further comprising providing a first reinforcing member and a second reinforcing member surrounding the insulative housing.

13. The method claimed in claim 9, wherein the first region extends outwardly to form two concave feet disposed at two sides thereof, the body portion extends outwardly to form two convex feet disposed at two sides thereof and matching with the concave feet, the convex feet are injection molded in the concave feet.

14. The method claimed in claim 9, further comprising the step of providing a pair of first retainers recessed in the base and a pair of first convex portions disposed on the body portion injection molded therein.

15. An electrical connector comprising:

an insulative housing made from a first material and defining, along a front-to-back direction, a front side around which a receiving space is formed, and another side to which a cover is attached;

an insulative body portion made from a second material and attached to the insulative housing, said second material being different from the first material and more suitable to be welded than the first material; wherein said cover is welded upon said body portion instead of upon said housing.

16. The electrical connector as claimed in claim 15, wherein said housing forms a plurality of terminal grooves in said another side, through which a plurality of terminals of a terminal module are inserted into the receiving space during assembling said terminal module into the housing in a vertical direction perpendicular to said front-to-back direction, said terminal grooves being shielded by said cover in said vertical direction.

17. The electrical connector as claimed in claim 16, wherein said housing defines a recessed region surrounding the terminal grooves in a top view along the vertical direction, and said body portion forms a frame structure received within said recessed region.

18. The electrical connector as claimed in claim 15, wherein said cover includes means for securing to the housing.

19. The electrical connector as claimed in claim 15, wherein said body portion is formed within the housing via an injection molding process.

20. The electrical connector as claimed in claim 15, wherein protrusions and holes of said housing and said body portion are engaged with each other so as to prevent relative movement between the housing and the body portion in a horizontal direction.

* * * * *